US007890312B2

(12) United States Patent
Devantier et al.

(10) Patent No.: US 7,890,312 B2
(45) Date of Patent: Feb. 15, 2011

(54) METHOD FOR PREDICTING LOUDSPEAKER PORT PERFORMANCE AND OPTIMIZING LOUDSPEAKER PORT DESIGNS UTILIZING BI-DIRECTIONAL FLUID FLOW PRINCIPLES

(75) Inventors: Allan Devantier, Newhall, CA (US); Zachary Rapoport, Northridge, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 11/205,773

(22) Filed: Aug. 16, 2005

(65) Prior Publication Data

US 2006/0052992 A1 Mar. 9, 2006

Related U.S. Application Data

(60) Provisional application No. 60/602,281, filed on Aug. 16, 2004.

(51) Int. Cl.
*G06G 7/50* (2006.01)

(52) U.S. Cl. ..... 703/9; 703/1; 703/6

(58) Field of Classification Search ..... 703/1, 703/6, 9; 381/345; 702/182
See application file for complete search history.

(56) References Cited

U.S. PATENT DOCUMENTS

| | | | | |
|---|---|---|---|---|
| 4,987,601 | A | 1/1991 | Goto et al. | |
| 5,109,422 | A | 4/1992 | Furukawa et al. | |
| 5,517,573 | A * | 5/1996 | Polk et al. | 381/345 |
| 5,714,721 | A | 2/1998 | Gawronski et al. | |
| 7,092,845 | B2 * | 8/2006 | Keane et al. | 702/182 |
| 2003/0076975 | A1 * | 4/2003 | Stead et al. | 381/345 |
| 2004/0131219 | A1 * | 7/2004 | Polk, Jr. | 381/345 |

OTHER PUBLICATIONS

Roozen et al., "Reduction of Bass-Reflex Port Nonlinearities by Optimizing the Port Geometry", presented at the 104th Convention of the Audio Engineering Society, May 1998, preprint 4661, pp. 1-24.*
Salvatti et al., "Maximizing Performance from Loudspeaker Ports", JAES vol. 50, No. 1, Dec. 2001, pp. 19-45.*
Raczynski, "How Good Is Your Port?", http://www.interdomain.net.au/~bodzio/PORTS.pdf, Dec. 2003, pp. 1-11.*
Gogg et al., "Introduction to Simulation", Proceeding of the 25th Conference on Winter Simulation, 1993, pp. 9-17.*
Audio Engineering Society Convention Paper; Presented at the 117th Convention; Oct. 28-31, 2004 San Francisco, CA, USA; 20 pages.
J. Audio Eng. Soc., vol. 50, No. ½, Jan./Feb. 2002; Salvatti et al; acknowledgement; references; bibliography; 1 page.
J. Audio Eng. Soc., vol. 50, No. ½, Jan./Feb. 2002; The Authors; only p. 45.

* cited by examiner

*Primary Examiner*—Kamini S Shah
*Assistant Examiner*—Herng-Der Day
(74) *Attorney, Agent, or Firm*—The Eclipse Group LLP

(57) ABSTRACT

A method is provided for predicting the performance of a loudspeaker port and optimizing port design. The method involves defining the geometries of a loudspeaker port, modeling the bi-directional fluid flow in the defined port utilizing a modeling method known as Computation Fluid Dynamics ("CFD") and analyzing the flow model to determine whether the flow characteristic displayed in the model represent optimum flow characteristics for port performance. To optimize port design, the geometries of the port may be altered and modeled until the flow characteristic represents flow indicative of optimum port performance.

16 Claims, 11 Drawing Sheets

METHOD FOR PREDICTING LOUDSPEAKER PORT PERFORMANCE AND OPTIMIZING LOUDSPEAKER PORT DESIGNS UTILIZING BI-DIRECTIONAL FLUID FLOW PRINCIPLES

RELATED APPLICATIONS

This application claims priority to U.S. Provisional Patent Application Ser. No. 60/602,281 filed on Aug. 16, 2004, titled Analysis and Modeling of the Bi-Directional Fluid Flow in Loudspeaker Ports, which is incorporated into this application by reference in its entirety.

BACKGROUND OF THE INVENTION

1. Field of the Invention

This invention relates generally to loudspeaker ports. More particularly, the invention relates to providing a method for predicting the performance of a loudspeaker port based on the modeling and analysis of bi-directional fluid flow through the loudspeaker port.

2. Related Art

Bass reflex ports are used in loudspeakers to enhance low frequency performance. Over the last few years, there has been increased interest in bass reflex ports driven by the need for better performance from smaller loudspeaker enclosures, i.e., higher maximum sound pressure level and wider bandwidth. Although there has been significant work done to reduce these negative effects, no optimal solution has been found.

At low sound levels the port extends the low frequency response by supplying one of the components of a Helmholtz resonator. However, at higher sound levels, the turbulent intensity in the port increases, which disrupts the Helmoholtz resonance and causes distortion, noise and compression. To eliminate the distortion, noise and compression occurring at higher sound levels, many studies have been conducted in an attempt to understand what causes the instability and optimize port design.

For example, in one study, it was suggested that a symmetrical port with a flange and a blend radius at each end was optimum. Another study concluded that a gently flared port with small radius is the optimum configuration to avoid unwanted effects. A more recent study concluded that ports with generous flares performed best at low sound levels, and straight ports performed best at very high levels. Based upon this conclusion, the study suggested that ports with moderate flares represented the best compromise and performed well over a wide range of sound pressure levels. This study also noted that port flow is bi-directional. Accordingly, both entrance and exit loses should be considered since both effect the performance of the port. Because this study only utilized data based upon unidirectional flow principles but recognized the port flow at bi-directional, the study found port symmetry to be an important design consideration.

Although with these studies, several conclusions were also made about what causes port instabilities, as well as, where and when instabilities incur. One such study established that an over-driven port is more erratic in nature than a port driven in the linear region. This study proved that instabilities start to occur when port velocities approach the 5 to 10 m/s range and that ports display hysteresis effects. Thus, once instability occurs in a port the drive level must be lowered significantly to restore stability.

Another study concluded that undesirable blowing noises are caused by boundary layer turbulence and unsteady separation of the acoustic flow at the port termination. From a numerical simulation of the flow through a port, the study further illustrates that vortices occur at the port termination for straight ports and closer to the center with more generously flared ports.

In reaching conclusions regarding port performance and optimal port designs, researcher based their conclusion upon port performance measured using either theory or experimentation based upon the characteristic of air or fluid through the port. It is well established that fluid flow characteristic in and around a port can be used to analyze and model port performance.

The flow in and around a loudspeaker port can be described as a complex high-speed oscillating acoustic flow of varying magnitude and frequency due to the forces created by the loudspeaker's transducer. When there is a combination of low frequency and high magnitude, flow conditions become such that areoacoustically generated noise can become a problem. If the flow within the port is thought of as a simple pipe flow problem, it is important to recognize that as the flow changes direction the inlet and outlet reverse their roles. Thus, the flow direction within a port can be characterized as either bi-directional or oscillating.

Although port flow is oscillating, unidirectional fluid flow principles are generally used to analyze and model port performance. While entrance and exit loses for unidirectional flows within a pipe are well documented, oscillating flows are not. Unidirectional flow principles demonstrate that if a pipe's inlet has a sharp edge, flow separation can be expected in a phenomenon known as "vena contracta." This flow separation can, however, be avoided by rounding the edge. Generally, the greater the radius, the less the loss. Further, a small amount of rounding can make a significant difference. Although entrance losses are heavily associated with geometry exit losses are not. Since flow separation is inevitable at the exit, it would be optimum for the flow to separate at the port termination. Using a straight pipe with a sharp edge provides the best opportunity for this to occur. As a result the optimum geometries for entrance and exit are significantly different based upon the principle of unidirectional flow.

Since port flow is bi-directional, entrance and exit geometry must be considered together to find an optimal profile. Oscillating or bi-direction flow does not follow many of the standard rules that govern unidirectional flows. While it is important to examine and understand the optimal inlet and outlet for unidirectional flows, to accurately model port flow to analyze and optimize port designs, bi-direction flow principles should also be utilized.

Accordingly, a need exists for a method for predicting port performance and optimizing port design using bi-directional fluid flow principles.

SUMMARY

A method is provided for predicting the performance of a loudspeaker port and optimizing port design. The method involves defining the geometries of a loudspeaker port, modeling the bi-directional fluid flow in the defined port utilizing a modeling method known as Computation Fluid Dynamics ("CFD") and analyzing the flow model to determine whether the flow characteristic displayed in the model represent optimum flow characteristics for port performance. To optimize port design, the geometries of the port may be altered and modeled until the flow characteristic represents flow indicative of optimum port performance.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

Turning now to FIGS. 1-15, a method is provided for predicting the performance of a loudspeaker port and optimizing port design. According to one example of one implementation, the method involves defining the port geometries, modeling the bi-directional fluid flow in the defined port utilizing a modeling method known as Computation Fluid Dynamics ("CFD") and analyzing the port model based to determine whether the flow characteristic displayed in the model representing optimum flow characteristic of port performance. To optimize port design, the geometries of port may be continuously altered and modeled until the flow characteristic represents flow indicative of optimum port performance.

As set forth above, the geometry of the port must first be determined. Although the method can be utilized in connection with a single loudspeaker port design, by way of example, the analysis and modeling of four different port designs are illustrated in FIGS. 1-15. Although the port and/or the flare profile of the port may be designed using any geometric shape Or combination of geometric shapes, the ports modeled for illustrated purposes in FIGS. 1-15 are defined by a section of a hyperbola. Further, a 15 mm blend radius was added to both ends and a flange was added to the inner end to reduce even harmonic distortion.

The four different ports selected for modeling were chosen from the following six ports, referred to below as SR, A, B, C, D & E and having the dimensions set forth below.

| Port Name | Port Length (mm) | Minimum Diameter (mm) | Initial Angle (degrees) |
|---|---|---|---|
| SR | 120 | 66.1 | 0 |
| A | 120 | 64.4 | 6.1 |
| B | 120 | 62.9 | 13.2 |
| C | 120 | 61.8 | 22.9 |
| D | 120 | 60.9 | 36.5 |
| E | 120 | 60.1 | 55.3 |

Figure 1:
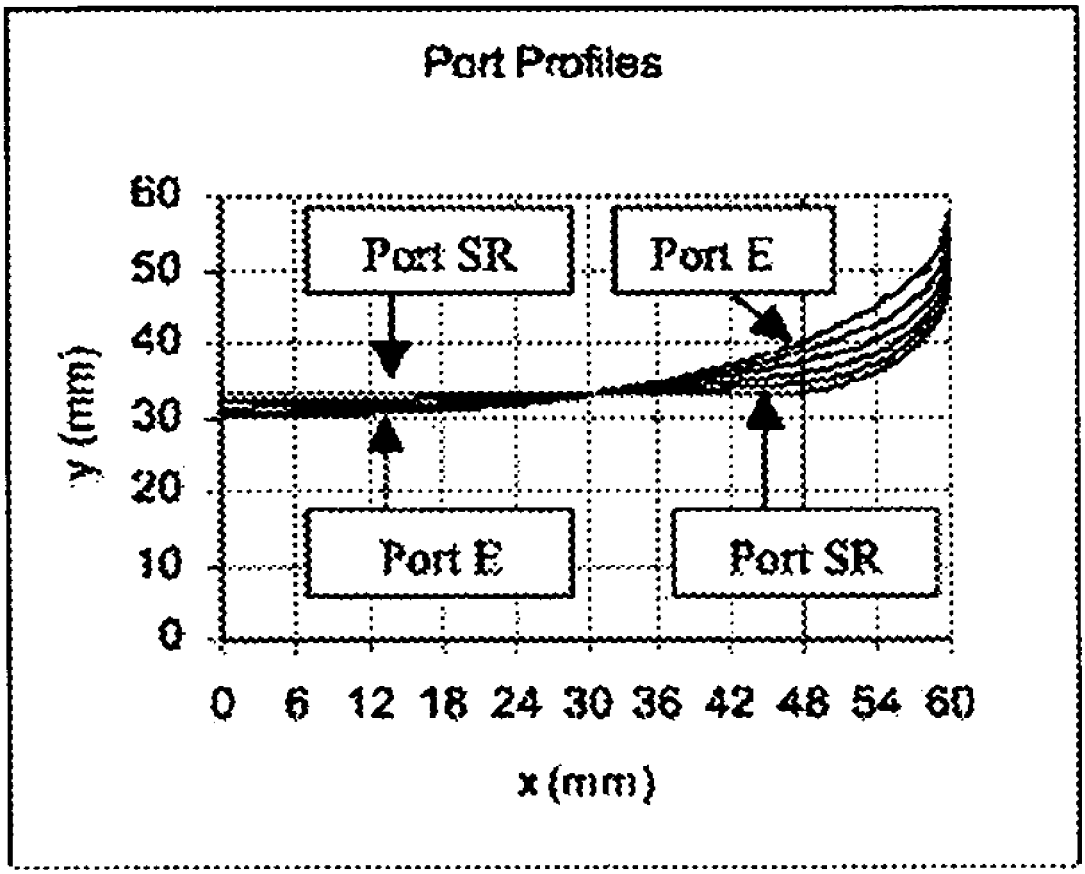
FIG. 1 illustrates the cross-sectional profile of six different ports used to demonstrate one example of one implementation of the method of the invention.

FIG. 1 shows the cross-sectional profile of each of six ports, SR, A, B, C, D & E. As illustrated by FIG. 1, port SR is a straight port with a simple blend radius. Port A has the least flare of six ports and Port E has the most flare. Thus, for purposes of illustration, Ports A & E were not modeled.

To achieve an accurate representation of the flow through a loudspeaker port, the conditions surrounding the port it is desirable to utilize conditions that are as close to real life conditions as possible. To generate these types of conditions, in addition to modeling the port, the port may be modeled in a enclosure and atmosphere that mimics the conditions of a loudspeaker in a room.

Figure 2:
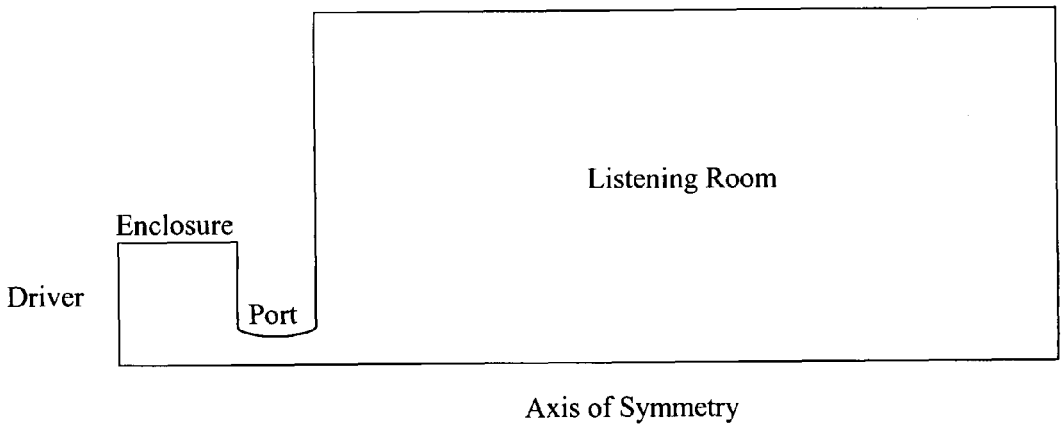
FIG. 2 illustrates one example of one implementation of the geometry used to model four of the ports illustrated in FIG. 1.

As illustrated in FIG. 2, in one example of one implementation, an enclosure may be sized to create a resonance of approximately 30 Hz and a transducer may be modeled using a boundary condition with a 30 Hz oscillation. The atmosphere may be designed to be large enough so that it does not affect the flow near the port. While a full 3D representation of flow may be modeled, modeling a 3D representation is more computationally intensive than a 2D computation. For purposes of illustration, a 2D axisymmetric model of the flow was computed.

To generate the mesh, a radial distance of the first grid node from the port wall must be set and may be one of the most significant decisions regarding mesh generation. The boundary layer can be approximated using establish attributes of oscillating flows that demonstrate that boundary layer thickness can be calculated using the following equation:

$$y=\eta\sqrt{2\nu/n}$$

Where $\eta$ represents a dimensionless distance from the wall, $\nu$ is the kinematic viscosity of air, and n equals $2*\pi*\omega$, where $\omega$ is the frequency.

Figure 3:
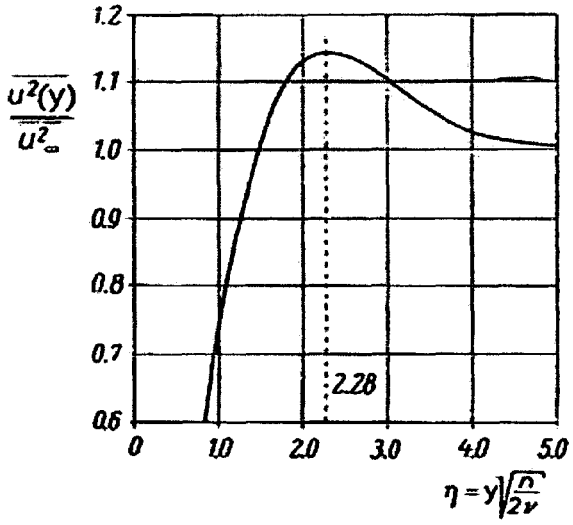
FIG. 3 is an example of a dimensionless boundary layer thickness for an oscillating flow in a pipe.

FIG. 3 illustrates as example of an application of this equation, which illustrates a dimensionless boundary layer thickness for an oscillating flow in a pipe. As illustrated, using a maximum value $\eta$ is 2.28 and a frequency of 30 Hz and $15*10^{-6}$ $m^2/s$ as the kinematic viscosity of air, the theoretical boundary layer thickness y is $9.096*10^{-4}$ m (or approximately 0.9 mm).

To understand the flow phenomena within the port, Computational Fluid Dynamics ("CFD") may be used to model the bi-directional flow within the port. The laws that govern the fluid flow can be represented by complex sets of nonlinear partial differential equations. CFD uses numerical methods, or Finite Element Analysis ("FEA"), to solve the partial differential equations that describe the fluid behavior.

Flows can be modeled using commercial CFD programs. While there are many commercial CFD programs available on the market that may be used to model the bi-directional fluid flow within a loudspeaker port, for purposes of illustration, a program commercially known as "FLUENT®" is used. FLUENT® requires the generation of both the geometry and mesh to take place prior to beginning computational methods. Although other preprocessors can be used in conjunction with FLUENT®, GAMBIT® is the preprocessor FLUENT® provides to generate the geometry and mesh.

To achieve good resolution, 12 nodes may be placed within the boundary layer. A uniform boundary layer was generated with the first grid point at 0.08 mm and growing at a rate of 0.05% for 12 nodes. Using an unstructured quadrilateral mesh, the remaining area was meshed growing at a rate of 2% moving away from the port walls. Those skilled in the art will recognize that, while the illustrate example utilizes 12 nodes within the boundary layer, any number of nodes may be utilized, as well different first grid points and different growth rates for the nodes.

The flow may then be simulated over a wide range of sound levels. Using the geometry and mesh, boundary conditions are assigned to adjust the flow. A sinusoidal velocity profile may be implemented on the simulated driver at the far left of the geometry. The magnitude of this velocity profile may be adjusted to simulate higher or lower sound pressure levels. The boundaries located on the far right and top of the geometry may be set to atmospheric pressure to simulate the outside world. Although FLUENT® has many turbulence models, the Large Eddy Simulation ("LES") model is one model applicable to this situation and can capture a wide range of eddies without undesirable smoothing effects that may come with other turbulence models. The LES is the model use to generate the flow models illustrated in FIGS. 4-15. Other methods may also be used, for example, a method known as Direct Numerical Simulation (DNS), which captures a full range of eddies, may also be used; however, DNS it is more computationally intensive than the LES model.

To ensure that the flow is fully developed, calculations may be run for two or more complete transducer cycles before any data is collected, then the following two or more cycles may be recorded as videos. Each cycle may be broken into 200 steps to capture all the flow phenomena, using, for example, a 30 Hz signal each time step is 0.167 milliseconds. Those skilled in the art will recognize that other cycles, other signals and other time steps may be use to record the flow data.

FIGS. 4-15 show the results of four loudspeaker-port simulations at three different Sound Pressure Levels ("SPL") using the FLUENT® CFD program. These plots show trends as a function of drive level and flare rate. In the example illustrations, velocity magnitude plots are used rather than streamline plots. Those skilled in the art will recognize that either type of plot may be utilized in additional to any other know methods for plotting fluid flow. FIGS. 4-15 are grayscale conversions taken from original color mpegs. While the snapshot for these illustrations is taken from the videos for the time slice that corresponds to 135 degrees into the fourth complete cycle of the sinusoidal oscillation, snapshots may be taken at different times. However, taken the videos for the time slice that corresponds to 135 degrees into the fourth complete cycle of the sinusoidal oscillation may be informative and representative of the overall fluid flow. Further, the flow is from left to right during this point of the animation. Although not discussed in detail in this application, to correlate the results of the CFD, the ports may also be prototyped and subjected to either or both objective and subjective tests. A full discussion of examples of both objective and subject tests to correlate the results can be found in U.S. Provisional Patent Application Ser. No. 60/602,281 filed on Aug. 16, 2004, titled Analysis and Modeling of the Bi-Directional Fluid Flow in Loudspeaker Ports, which is incorporated into this application by reference in its entirety.

Figure 4:
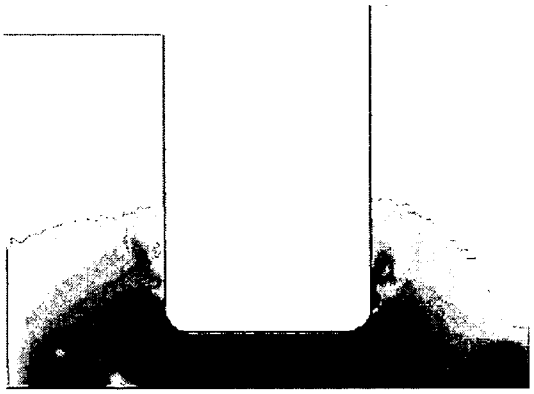
FIG. 4 illustrates the velocity magnitude of Port SR at a low sound pressure level.
Figure 5:
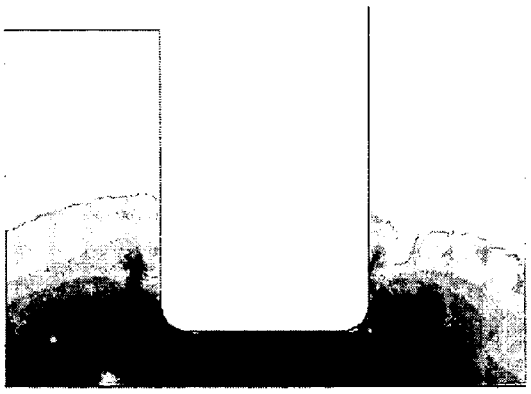
FIG. 5 illustrates the velocity magnitude of Port SR and a medium sound pressure level.
Figure 6:
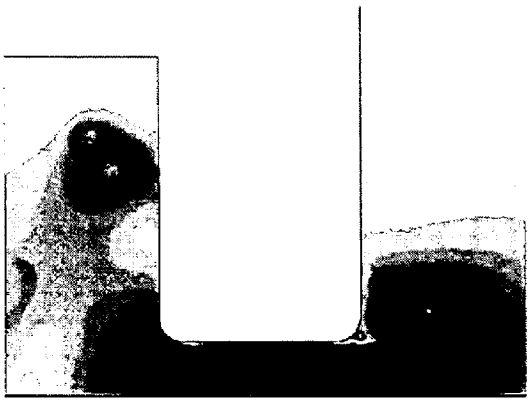
FIG. 6 illustrates the velocity magnitude of Port SR at a high sound pressure level.

With respect to Port SR, FIG. 4 illustrates the velocity magnitude of Port SR at a low sound pressure level. FIG. 5 illustrates the velocity magnitude of Port SR and a medium sound pressure level. FIG. 6 illustrates the velocity magnitude of Port SR at a high sound pressure level.

Figure 7:
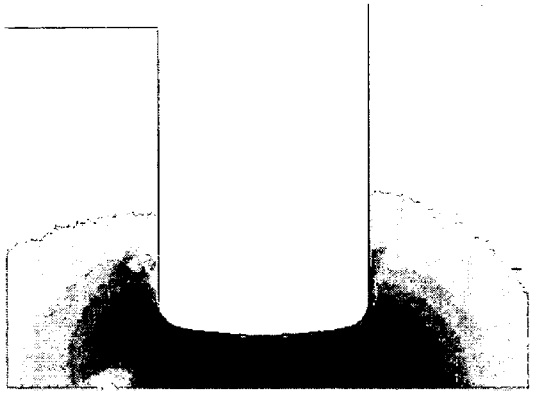
FIG. 7 illustrates the velocity magnitude of Port B at low sound pressure level.
Figure 8:
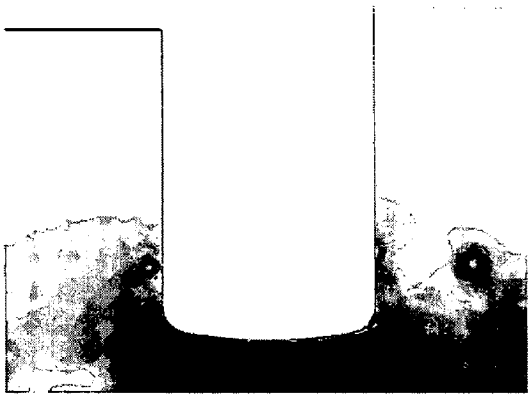
FIG. 8 illustrates the velocity magnitude of Port B at a medium sound pressure level.
Figure 9:
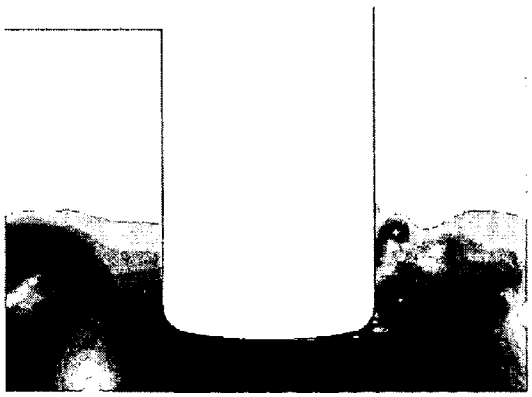
FIG. 9 illustrates the velocity magnitude of Port B at a high sound pressure level.

With respect to Port B, FIG. 7 illustrates the velocity magnitude of Port B at low sound pressure level. FIG. 8 illustrates the velocity magnitude of Port B at a medium SPL. FIG. 9 illustrates the velocity magnitude of Port B at a high sound pressure level.

Figure 10:
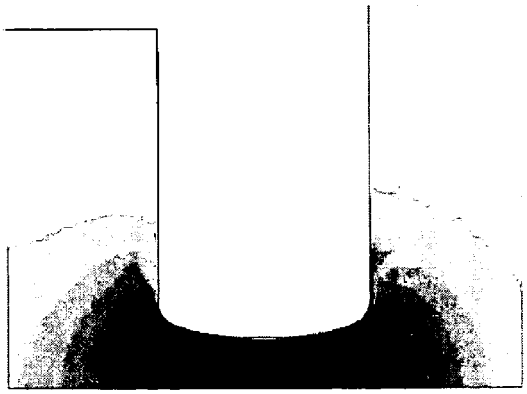
FIG. 10 illustrates the velocity magnitude of Port C at a low sound pressure level.
Figure 11:
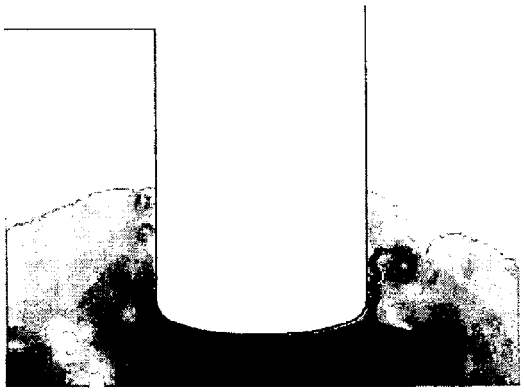
FIG. 11 illustrates the velocity magnitude of Port C and a medium sound pressure level.
Figure 12:
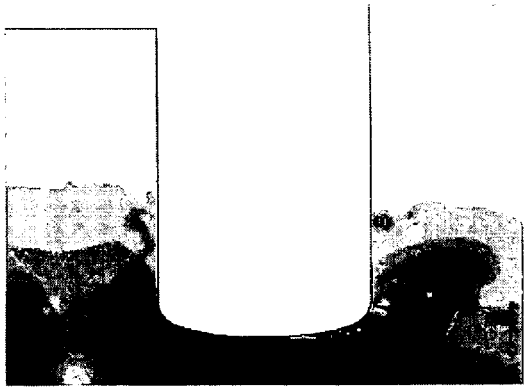
FIG. 12 illustrates the velocity magnitude of Port C at a high sound pressure level.

With respect to Port C, FIG. 10 illustrates the velocity magnitude of Port C at a low sound pressure level. FIG. 11 illustrates the velocity magnitude of Port C and a medium sound pressure level. FIG. 12 illustrates the velocity magnitude of Port C at a high sound pressure level.

Figure 13:
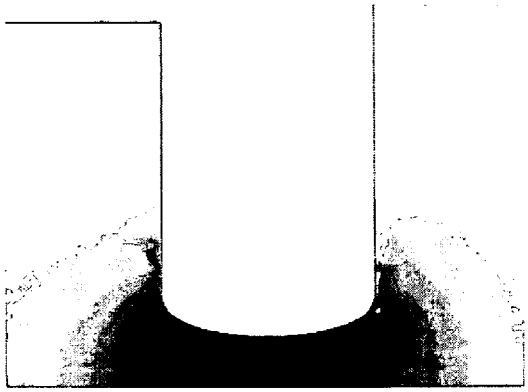
FIG. 13 illustrates the velocity magnitude of Port D at a low sound pressure level.
Figure 14:
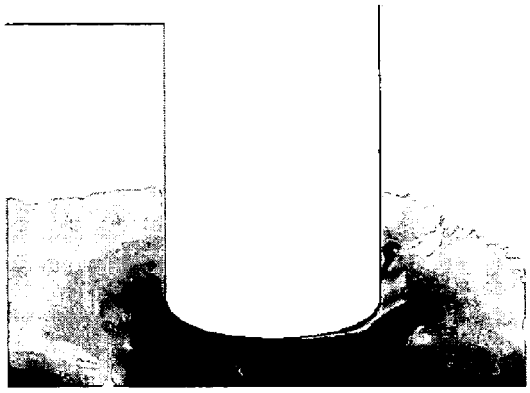
FIG. 14 illustrates the velocity magnitude of Port D and a medium sound pressure level.
Figure 15:
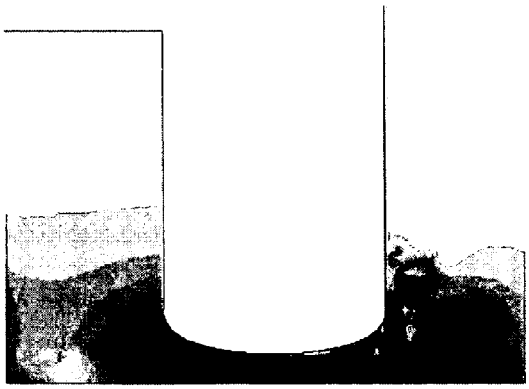
FIG. 15 illustrates the velocity magnitude of Port D at a high sound pressure level.

With respect to Port D, FIG. 13 illustrates the velocity magnitude of Port D at a low sound pressure level. FIG. 14 illustrates the velocity magnitude of Port D and a medium sound pressure level. FIG. 15 illustrates the velocity magnitude of Port D at a high sound pressure level.

From an objective view point, flow separation can occur on entrance or exit. An optimum port design will delay the onset of separation to the highest possible levels. From a subjective view point, separation on entrance and exit sound different, with entrance separation sounding worse. Therefore, an optimum design will force separation on exit to happen first, but will be shallow enough to delay the onset of separation to the highest possible level. As illustrated in FIG. 4-14, vena contracta effects can be clearly seen in Port SR for all drive levels. At the middle and high drive levels we see the evidence of "vortex shedding". Accompanying the vortex is a large mass of high velocity fluid exiting along with the main flow.

Port B, C, and D all have no obvious signs of vena contracta. At medium drive levels the plots look "worse" than that of port SR. However, it is interesting to note that the exit of the main flow is free of significant artifacts and that the vortices that are evident appear to be diverging away from the main flow. At high sound pressure levels all four ports exhibit evidence of vortex shedding.

As previously noted, objective tests can be performed to correlate the results of the bi-directional modeling. In one example of objective testing, ports may be mounted in a 66 liter bass reflex enclosure fitted with two low-distortion 30 cm woofers. The system may then be measured in a large anechoic chamber fitted with 1220 mm wedges and driven with a 31.4 Hz sine wave ranging from 1.0 VRMS to 25.1 VRMS in 1 dB increments. A microphone may be placed 45 degrees off the port axis to reduce the random effects that occur when a vortex hits the microphone. Those skilled in the art will recognize that other parameters and other testing methods may also be utilized.

Using the above described parameters, objective testing can be performed on the six ports having the profiles as illustrated in FIG. 1 to correlate the results of the modeling of the bi-directional fluid flow of the ports.

Figure 16:
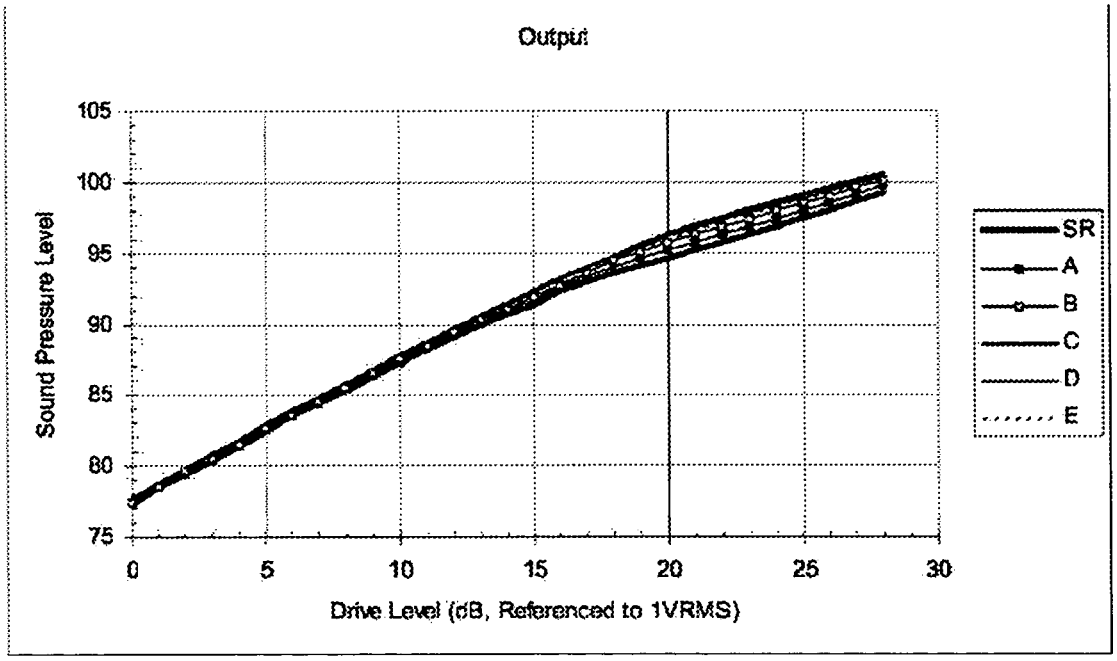
FIG. 16 illustrates an example of an objective test performed on the six port illustrated in FIG. 1 and shows sound pressure level output as a function of drive level for all six ports.
Figure 17:
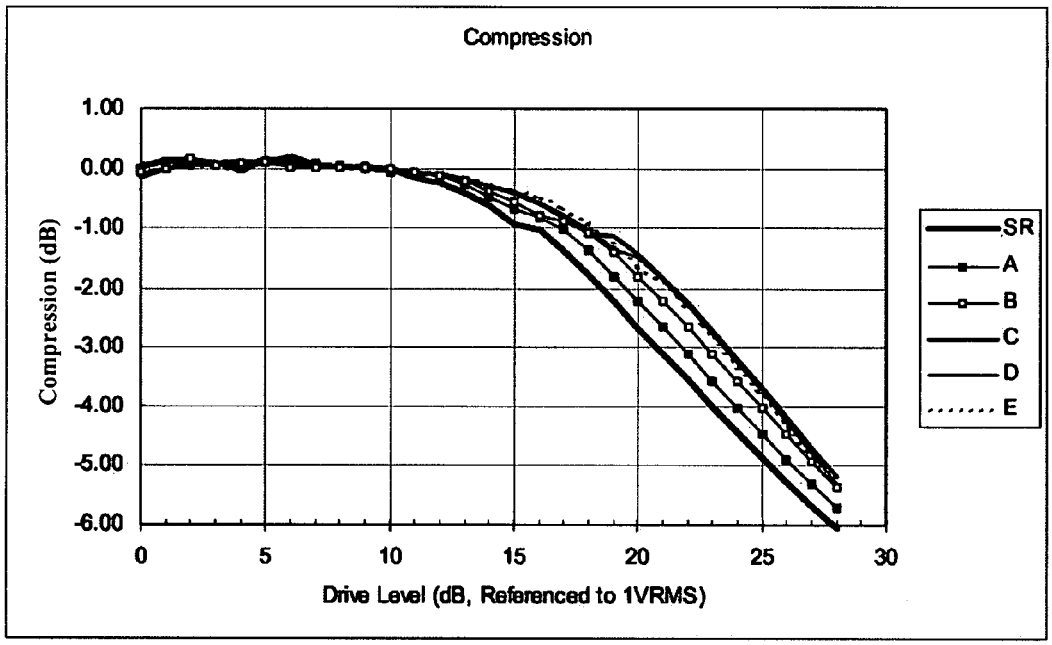
FIG. 17 illustrates an example of an objective test performed on the six port illustrated in FIG. 1 and shows compression as a function of drive level for all six ports.

FIG. 16 shows the Fundamental Sound Pressure Level as a function of drive voltage and FIG. 17 shows the compression as a function of drive level. Transducer thermal compression is a contributing factor, but should be consistent from port-to-port making comparisons valid. Port C had the most output and least compression over the entire test range. Output and compression for the ports with more generous flare (port D and E) was slightly lower. While output and compression for the straight port and the ports with the more subtle flare was significantly worse.

Figure 18:
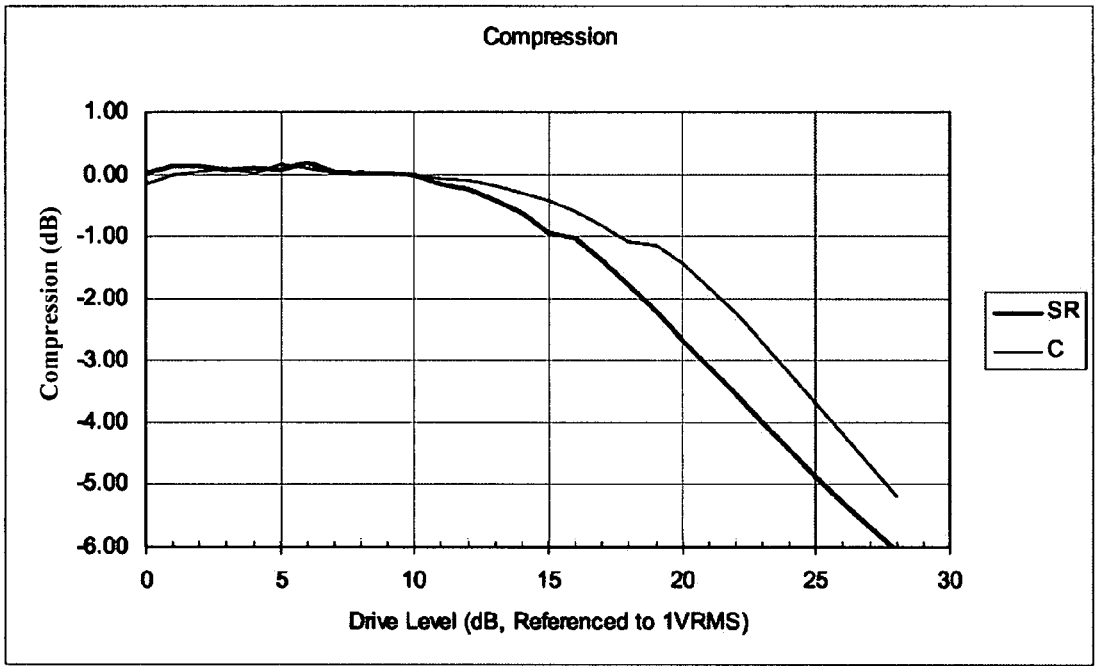
FIG. 18 illustrates an example of an objective test performed on the six port illustrated in FIG. 1 and shows compression as a function of drive level for Ports SR and C at 16 dB and 19 dB.

FIG. 18 shows the compression of port SR and C only. Note the discontinuities in the compression curves with drive levels of 16 dB and 19 dB respectively. This effect was evident on all ports and marked the onset of turbulence in the boundary layer, thus acting like an "air bearing" and actually reducing loses in the port.

Figure 19:
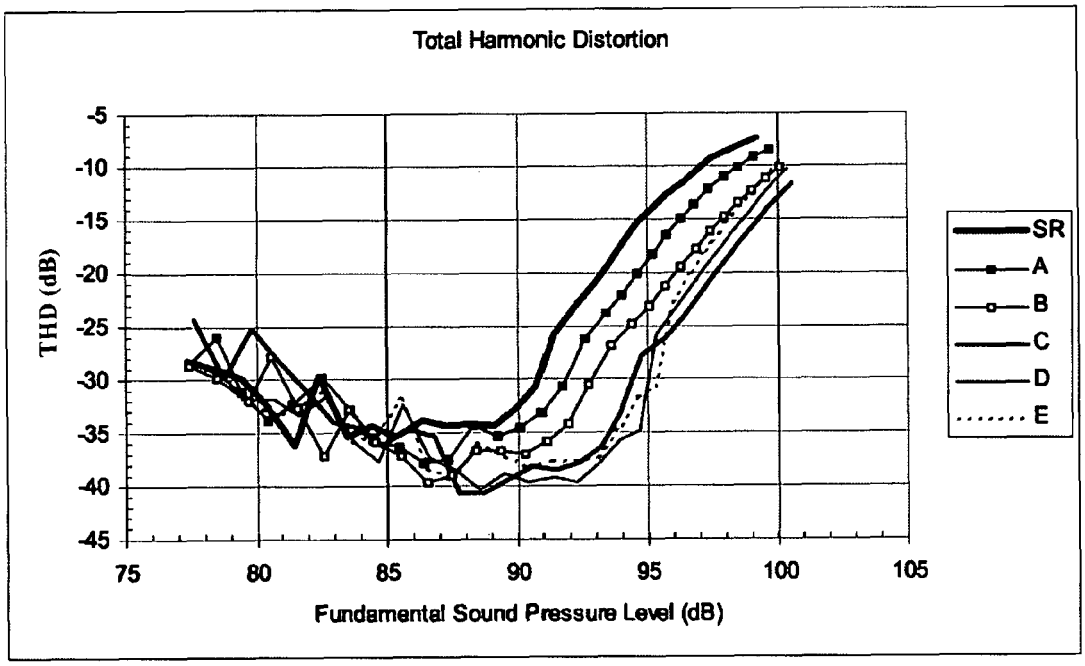
FIG. 19 illustrates an example of an objective test performed on the six port illustrated in FIG. 1 and shows total harmonic distortion as a function of fundamental sound pressure level for all six ports.
Figure 20:
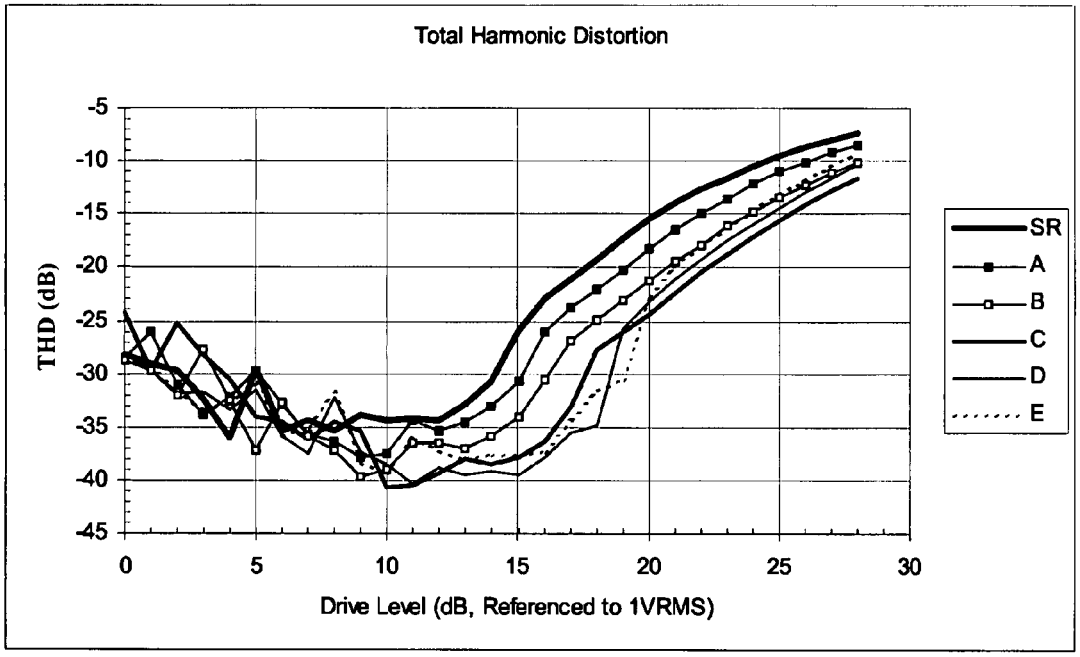
FIG. 20 illustrates an example of an objective test performed on the six port illustrated in FIG. 1 and shows total harmonic distortion as a function of drive level for all six ports.

FIG. 19 shows the Total Harmonic Distortion (up to the $86^{th}$ harmonic) as a function of Fundamental Sound Pressure Level and FIG. 20 shows the THD as a function of drive level. The trends are the same for both curves. Three distinct regions can be seen as a function of drive level: low, medium and high, each with its own unique attributes. At drives levels below 10 dB (referenced to 1VRMS) THD drops with drive level for all ports. This suggests that THD is below the noise floor of the measurement. For drive levels between 10 dB and 20 dB distortion decreases as flare rate increases. For drive levels above 20 dB Port C has the lowest THD.

Figure 21:
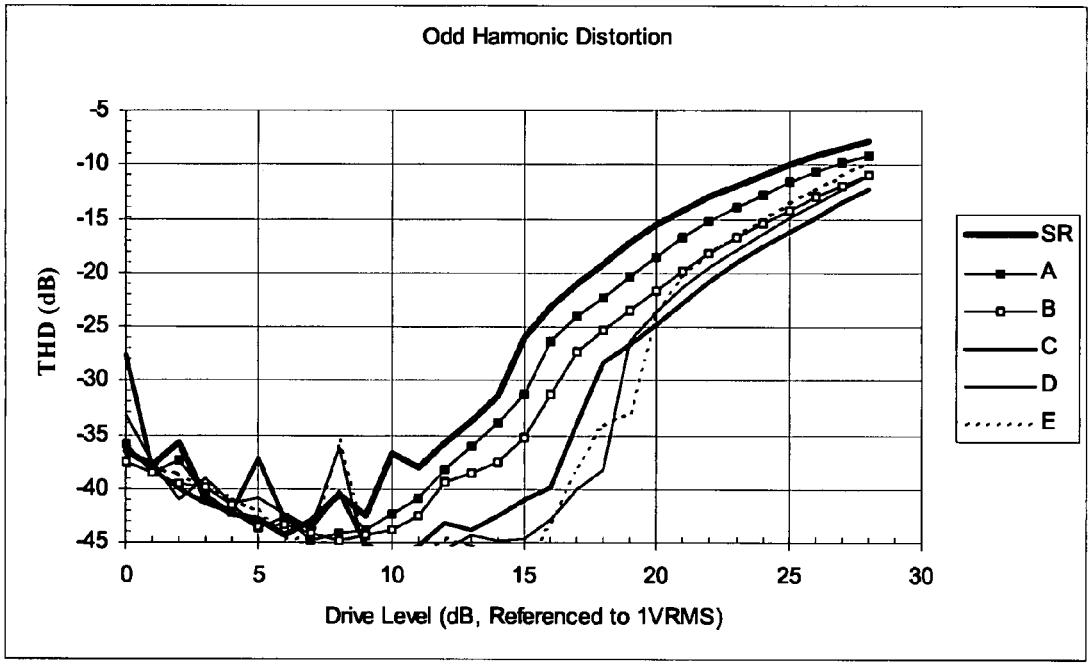
FIG. 21 illustrates an example of an objective test performed on the six port illustrated in FIG. 1 and shows odd harmonic distortion as a function of drive level for all six ports.
Figure 22:
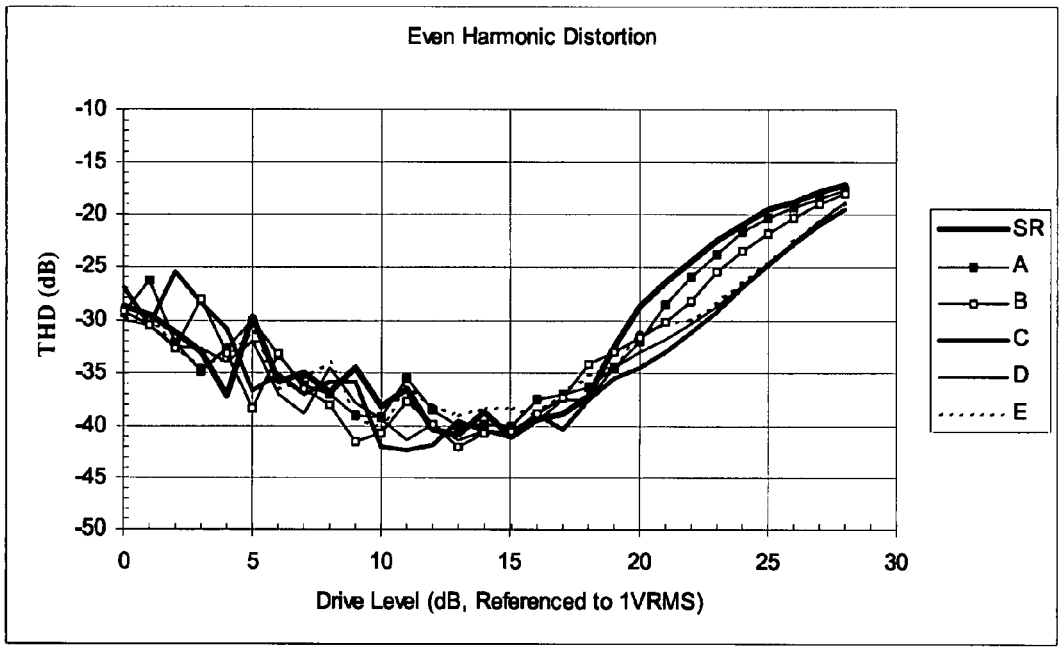
FIG. 22 illustrates an example of an objective test performed on the six port illustrated in FIG. 1 and shows even harmonic distortion as a function of drive level for all six ports.

FIG. 21 shows the Odd Harmonic Distortion as a function of drive level and FIG. 22 shows the Even Harmonic Distortion. The trends shown in the THD curves are continued here; at medium Sound Pressure Levels higher flare rate improves performance, while at the highest levels there appears to be a "middle ground" (Port C) that is optimum.

The foregoing description of an implementation has been presented for purposes of illustrations and description. It is not exhaustive and does not limit the claimed inventions to the precise form disclosed. Modifications and variations are possible in light of the above description or may be acquired from practicing the invention. For example, the described method may also utilize other methods for optimizing port design and predicting port performance in addition to flow visualization, such of methods may include as to using a predefined metric to measure turbulent intensity within a port or using a predefined metric to minimize sound pressure level. Note also that the implementation may vary between systems. The claims and their equivalents define the scope of the invention.

What is claimed is:

1. A method for optimizing the performance of a loudspeaker port, the method comprising:

defining at least one geometric associated with the loudspeaker port;

modeling a bi-directional fluid flow through the loudspeaker port based upon the at least one geometric utilizing a Computation Fluid Dynamics ("CFD") modeling method and where modeling calculations are executed for two complete transducer cycles before data is collected, where the data is non-statistical data;

obtaining a representation of the bi-directional fluid flow through the loudspeaker port;

analyzing the representation of the bi-directional fluid flow through the loudspeaker port to determine whether the representation of the bi-directional fluid flow through the loudspeaker is indicative of a port design where an exit flow separation occurs prior to an entrance flow separation; and if the representation of the bi-directional fluid flow through the loudspeaker port is not indicative of a port design where an exit flow separation occurs prior to an entrance flow separation, then redefining the at least one geometric associated with the loudspeaker port, and repeating the modeling, obtaining and analyzing steps until the representation of the bi-directional fluid flow through the loudspeaker port is indicative of a port design where an exit flow separation occurs prior to an entrance flow separation and optimizing the performance of the loudspeaker port by utilizing the at least one geometric that was redefined that resulted in the representation of the bi-directional fluid flow through the loudspeaker port where the exit flow separation occurred prior to the entrance flow separation.

2. The method of claim 1 further including the step of optimizing port design by altering the geometric of the loudspeaker port and repeating the steps of modeling the bi-directional fluid flow, obtaining a representation of fluid flow, and analyzing the representation of fluid flow until the representation of fluid flow is indicative of optimum port performance.

3. The method of claim 1 where defining one or more geometric associated with the loudspeaker port includes defining a section of a hyperbola.

4. The method of claim 1 where defining one or more geometric associated with the loudspeaker port includes adding a flange to an inner edge of the loudspeaker port.

5. The method of claim 1 where defining one or more geometric associated with the loudspeaker port includes defining a blend radius for at least one end of the loudspeaker port.

6. The method of claim 1 where the step of modeling the bi-directional fluid flow includes modeling a two-dimensional axisymmetric representation of the fluid flow.

7. The method of claim 1 where the step of modeling the bi-directional fluid flow includes modeling a three-dimensional axisymmetric representation of the fluid flow.

8. The method of claim 1 further including generating a mesh for the loudspeaker port.

9. The method of claim 1 further including calculating a thickness ("y") for a boundary layer in the loudspeaker port.

10. The method of claim 9 further including defining at least one node within the boundary layer.

11. The method of claim 10 further including calculating the thickness using the following equation:

$$y=\eta\sqrt{2\nu/n}$$

where $\eta$ represents a dimensionless distance from a wall of the loudspeaker port, $\nu$ is equal to a kinematic viscosity of air, and n is equal to $2(\pi)(\omega)$, where $\omega$ is a frequency at which the bi-directional fluid flow resonates through the loudspeaker port.

12. The method of claim 1 further including performing an objective test corresponding to the representation of fluid flow through the loudspeaker port.

13. The method of claim 1 further including simulating the bi-directional fluid flow for a plurality of sound levels.

14. The method of claim 13 further including assigning boundary conditions of the loudspeaker port to adjust the simulated bi-directional fluid flow.

15. The method of claim 13 further including implementing a sinusoidal velocity profile on a simulated driver corresponding to the loudspeaker port.

16. The method of claim 1 further including modeling conditions surrounding the loudspeaker port so as to mimic conditions of a loudspeaker in a room.

* * * * *

UNITED STATES PATENT AND TRADEMARK OFFICE

CERTIFICATE OF CORRECTION

PATENT NO. : 7,890,312 B2
APPLICATION NO. : 11/205773
DATED : February 15, 2011
INVENTOR(S) : Devantier et al.

It is certified that error appears in the above-identified patent and that said Letters Patent is hereby corrected as shown below:

Column 7, line 54, "the loudspeaker is" should be changed to --the loudspeaker port is--

Signed and Sealed this
Twenty-fifth Day of October, 2011

David J. Kappos

David J. Kappos
*Director of the United States Patent and Trademark Office*